US007573215B2

(12) United States Patent
Hillen

(10) Patent No.: US 7,573,215 B2
(45) Date of Patent: Aug. 11, 2009

(54) ACTUATING DEVICE FOR A MOVABLE COMPONENT

(75) Inventor: Jörg Hillen, Nörtershausen (DE)

(73) Assignee: Stabilus GmbH, Koblenz (DE)

( * ) Notice: Subject to any disclaimer, the term of this patent is extended or adjusted under 35 U.S.C. 154(b) by 118 days.

(21) Appl. No.: 11/602,819

(22) Filed: Nov. 21, 2006

(65) Prior Publication Data

US 2007/0114960 A1 May 24, 2007

(30) Foreign Application Priority Data

Nov. 21, 2005 (DE) ..... 10 2005 055 788

(51) Int. Cl.
*E05F 15/00* (2006.01)

(52) U.S. Cl. ..... 318/280; 318/282; 318/286; 318/15

(58) Field of Classification Search ..... 318/264–266, 318/280, 286, 466–470, 626, 9, 15, 282
See application file for complete search history.

(56) References Cited

U.S. PATENT DOCUMENTS 5,015,930 A * 5/1991 Kikuta et al. ..... 318/466
5,052,730 A * 10/1991 Frank et al. ..... 292/201
6,129,627 A * 10/2000 Jankowski et al. ..... 454/155
2002/0117863 A1 * 8/2002 Shinkawa ..... 292/216
2006/0156846 A1 * 7/2006 Neubauer et al. ..... 74/425

* cited by examiner

*Primary Examiner*—Bentsu Ro
(74) *Attorney, Agent, or Firm*—Cohen Pontani Lieberman & Pavane LLP

(57) ABSTRACT

An actuating device for a movable component includes a reversible motorized drive for driving the movable component from a normal position into an open position, the movable component being uncouplable from the reversible motorized drive in its open position. The actuating device includes a driving element movably drivable by the reversible motorized drive and engages in a crank recess and extending along the path of motion of the movable component. A length of the crank recess corresponds at least to a path of motion of the driving element between its normal position and its open position or partially open position. After adjustably driving the movable component into its open position, the driving element may be returned by the reversible motorized drive into the normal position.

35 Claims, 5 Drawing Sheets

ACTUATING DEVICE FOR A MOVABLE COMPONENT

BACKGROUND OF THE INVENTION

1. Field of the Invention

The present invention relates to an actuating device with a motorized drive for driving a movable component from a normal position into an open position and a free wheel permitting uncoupling of the movable component from the motorized drive in the open position.

2. Description of the Related Art

In an actuating device for actuating a flap, it is known that when the motorized drive is switched off and the opened flap is manually closed, a driving pinion for motorized pivoting of the flap is uncoupled from the motorized drive by a free wheel. The free wheel may be configured as a free-wheeling hub or as a switchable coupling, which is arranged on the drive shaft of the motorized drive. This design of an actuating device is complex and costly.

SUMMARY OF THE INVENTION

An object of the present invention is to provide an actuating device for actuating a movable component such as a flap with a simple construction of the movable component along with a motorized drive which allows manual actuation with little manual force.

The object is achieved in that a driving element is movably drivable by a reversible motorized drive and engages in a crank recess extending along the path of motion of the movable component, the length of the crank recess corresponding at least to the path of motion of the driving element between its normal position and its open position or partially open position. A switching device is operatively arranged so that after adjustably driving the movable component into its open position, the driving element may be returned by the motorized drive into the normal position.

The object is also achieved in that a crank component is movably drivable by the reversible motorized drive and comprises a crank recess extending along the path of motion of the movable component, into which a driving element arranged on the movable component engages, the length of the crank recess corresponding at least to the path of motion of the driving element between its normal position and its open position or partially open position. A switching device is operatively arranged so that after adjustably driving the movable component into its open position, the crank component may be returned by the motorized drive into the normal position.

In these embodiments, after motorized movement of the movable component into its open position, the driving element and/or the crank component is/are again returned in a motorized manner into its/their normal position. If the movable component is now to be moved manually from its open position into its normal position, the driving element is able to move freely and without resistance in the crank recess.

Furthermore, if the movable component is movably drivable by the reversible motorized drive by the driving element or the crank component from its open position into its normal position and, by the switching device, after adjustably driving the movable component into its normal position, the driving element or the crank component may be returned by the motorized drive into its normal position, the ability to move the movable component manually and substantially without resistance from its normal position into its open position is, therefore, also possible.

The switching device may simply comprise switching elements, which detect when the driving element has reached the end or ends of the crank recess.

A simple design for moving the movable component is for one or both ends of the crank recess to form stops against which the driving element may bear and, by moving the driving element or by moving the crank component, the movable component is movably drivable.

An emergency cut-out is achieved in that the stop or stops, when impinged upon by the driving element towards the end of the crank recess, are spring stops which may be deflected counter to a set spring force, the set spring force being greater than the force applied by the driving element when the driving element or the crank component is driven by the motorized drive. When the spring stops are deflected by the driving element, either a switch generating a switch signal is actuated or an increased power consumption of the motor is identified. The motorized drive is able to be switched off in response to the switch signal or the increased power consumption of the motor.

Thus, normal motorized driving of the movable component does not result in compression of the spring stops by the driving element. In the case of misuse, if the motorized drive is manually engaged on the movable component counter to the drive direction, the spring stop is deflected by the set spring force being overcome and the switch actuated so that the motorized drive is switched off. Thus, the motorized drive is protected against damage.

Alternatively, however, an overload clutch, such as for example a slip clutch may be arranged in the drive train between the motorized drive and the movable component.

The motorized drive may be a linear drive or a rotary drive. For force transmission, the driving element or the crank component may preferably be driven by the motorized drive via a gear mechanism. The motorized drive may be a pneumatic drive or a hydraulic drive. Preferably, however, the motorized drive is an electromotor. The movable component may, for example, be held by a latching device in its open position.

If force is able to be applied to the movable component by a spring in the direction of motion from the normal position into the open position, the spring preferably being a pneumatic spring, this results not only in retaining the movable component in the open position but also in supporting the motorized drive during movement of the movable component from the position into the open postiton. This is particulary advantageous if the movable component has to be lifted during this movement.

The support by the pneumatic springs may take place over the entire path of motion of the movable component or, however, only over a portion of the path of motion. In this connection, the movable component is, or carries, a flap for closing an opening. This may be a flap on a motor vehicle or, however, even a flap on an item of furniture, such as for example a cabinet. In this connection, the flap is movable drivable from a vertical normal position into a raised open position.

The movable component may be movably drivable in a linear manner between the normal position and the open position and the crank recess extends in a straight line. It is, however, also possible that the movable component may be rotatbly driven in a rotational manner about a rotational axis between the normal position and the open position and the crank recess extends in the manner of a circular segment.

A compact construction results when the crank recess is configured in a crank gear or drive wheel rotatably mounted about a rotational axis, which may be rotatably driven by the motorized drive. In this connection, the movable component may be a lever arm.

To achieve a motion characteristic deviating from a pivoting movement, it is possible for the lever arm to be a lever arm of a linkage, in particular a four bar linkage. In this connection, the four bar linkage may consist of the lever arm, a link rod which may be pivoted with one end aobut a second rotational axis parallel to the rotatinal axis, and a connecting rod coupled to the free ends of the lever arm and link rod, at a distance from one another, the flap being able to be fixedly arranged on the connecting rod.

Other objects and features of the present invention wil become apparent from the following detailed description considered in conjunction with the accompanying drawings. It is to be understood, however, that the drawings are designed soley for purposes of illustratin and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Embodiments of the invention are shown in the drawings and are described in more detail hereinafter.

DETAILED DESCRIPTION OF THE PRESENTLY PREFERRED EMBODIMENTS

Figure 1:
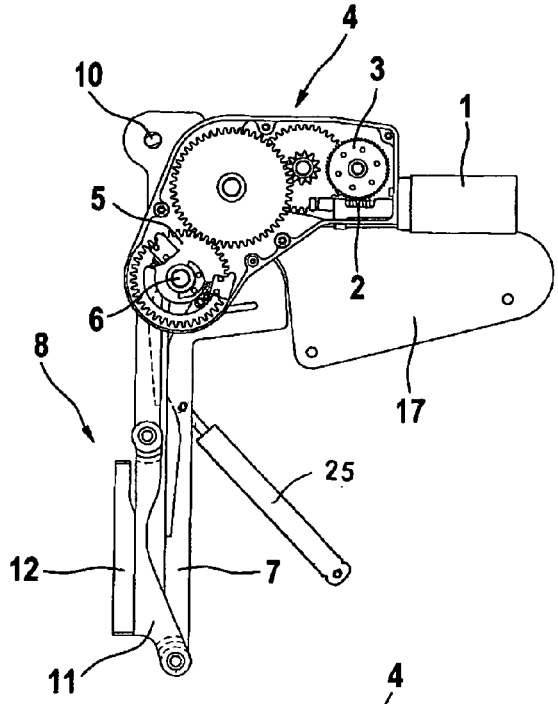
FIG. 1 is a schematic sectional side view of an actuating device with a four bar linkage in a lowered normal position.

The actuating device shown has a reversible electromotor 1, of which the drive shaft 2 is configured as a worm, by means of which a worm gear 3 may be rotatably driven. The worm gear 3 is the first gear of a gear mechanism 4 comprising a plurality of gears, of which the last gear is a crank gear 5, which is rotatably mounted about a rotational axis 6. The electromotor 1 and gear mechanism 4 are arranged in a housing 17.

A lever arm 7 of a four bar linkage 8 is, moreover, pivotably mounted about the rotational axis 6 and further comprises a link rod 9 which is pivotably mounted with its one end about a second rotational axis 10 arranged parallel at a distance therefrom and approximately perpendicular above the rotational axis 6.

A connecting rod 11 of the four bar linkage is coupled with one of its respective ends to the two free ends of the lever arm 7 and the link rod 9. A flap 12 for closing, resting on the connecting link 11, is fastened to the opening of a cabinet, not shown. The crank gear 5 comprises a crank recess 13 extending concentrically to the rotational axis 6 by approximately 180° and configured as an elongate hole into which a driving element 14, which is fixedly arranged on the lever arm 7 and extends in a camlike manner parallel to the rotational axis 6, projects.

The ends of the crank recess 5 form a first stop 15 and a second stop 16 for limiting the mobility of the driving elment 14 along the longitudinal extension of the crank recess 13. On a component, not shown, of the housing 17 a first switch 18 is arranged which may be actuated when the driving element 14 bears against the first stop 15. On the component, not shown, of the housing 17, moreover, a second switch 19 is arranged which may be actuated when the driving element 14 bears against the second stop 16.

Figure 2:
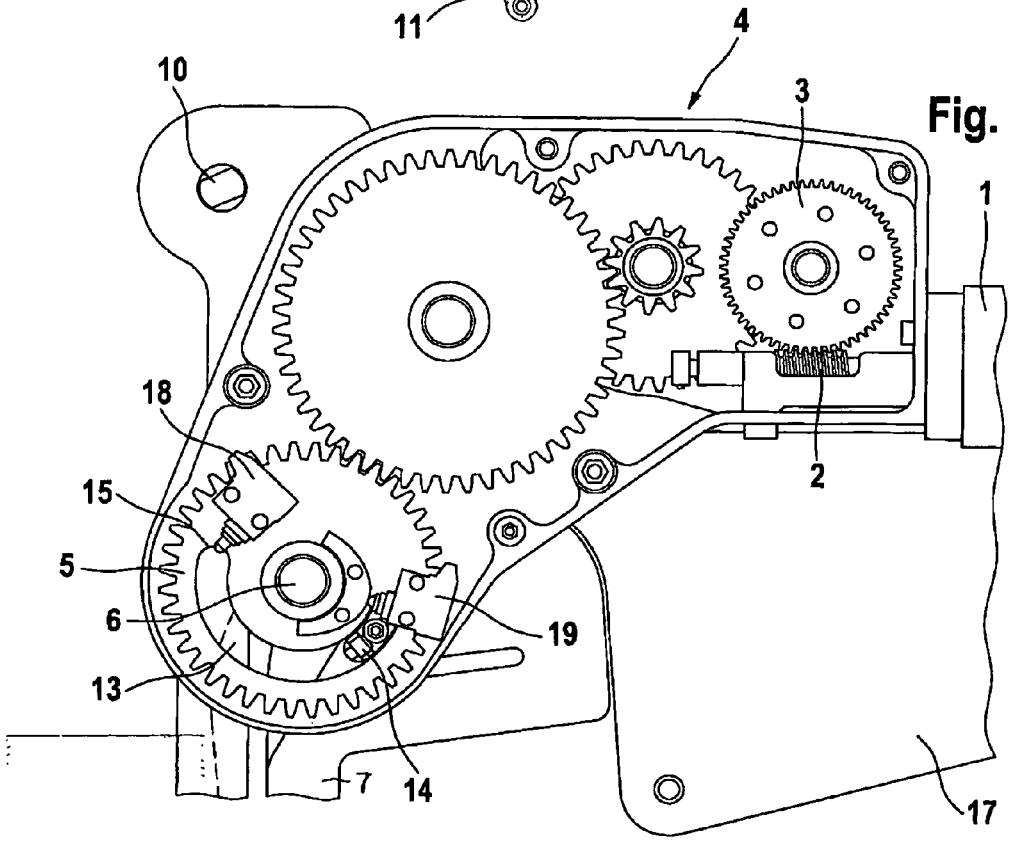
FIG. 2 is an enlarged side view of the actuating device according to FIG. 1.

In FIGS. 1 and 2, the normal position of the four bar linkage 8 is shown, in which the flap 12 is located in its aligned lower position and closes an opening, not shown, of a cabinet. The driving element 14 is thus located in its normal position and bears against the second stop 16 of the crank recess 13. The electromotor 1 is switched off. It would therefore be possible for the flap 12 to be manually raised and lowered again, the driving element 14 being able to move freely in the crank recess 13. If the electromotor 1 is switched on, it drives the crank gear 5 rotatably in a clockwise directin via the gear mechanism 4.

Figure 3:
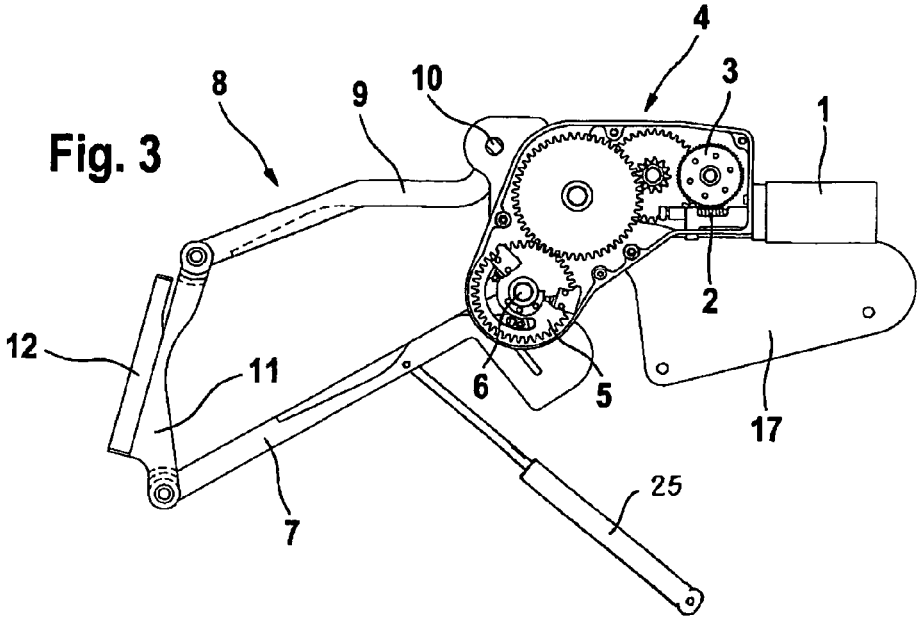
FIG. 3 is a schematic sectional side view of an actuating device of FIG. 1 in a partially raised postion.
Figure 4:
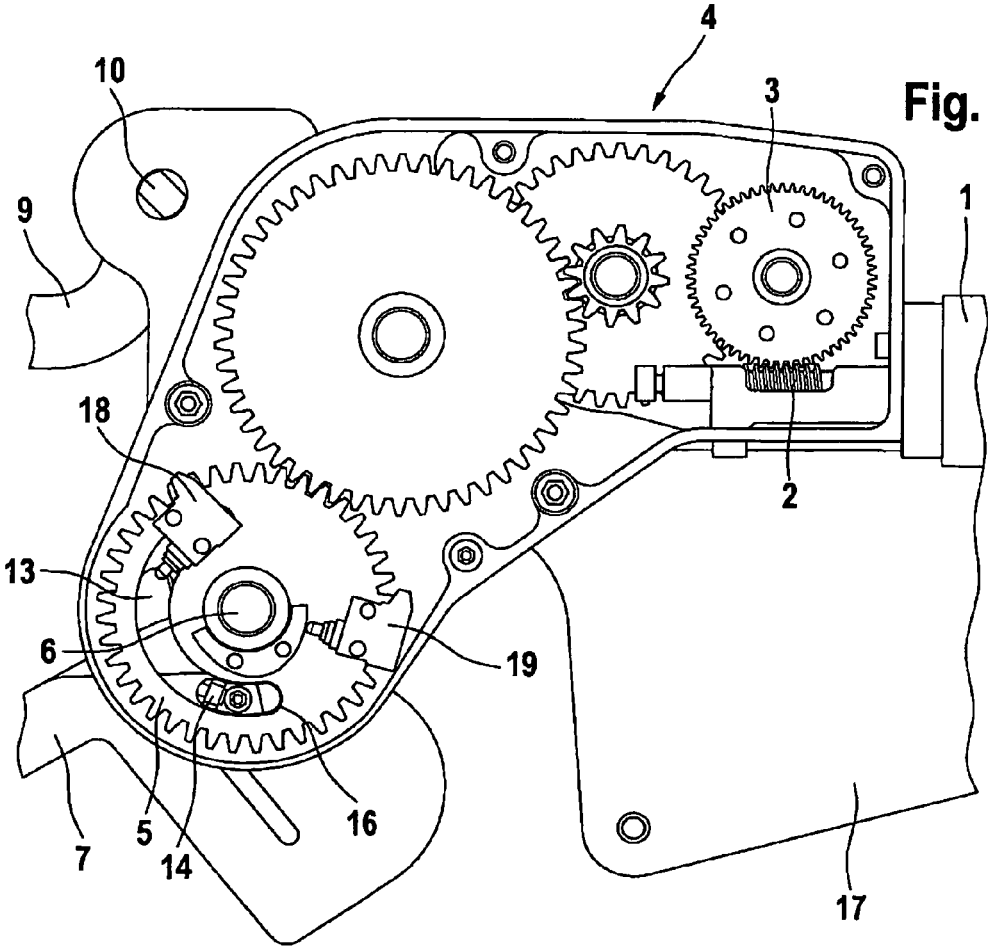
FIG. 4 is an enlarged side view of the actuating device according to FIG. 3.

As the driving element 14 already bears against the second stop 16, said driving element 14 and the lever arm 7 therewith are also driven in a pivoting manner and in a clockwise direction about rotational axis 6, by means of the crank gear 5 as far as a partially raised partially open position (FIGS. 3 and 4).

Figure 5:
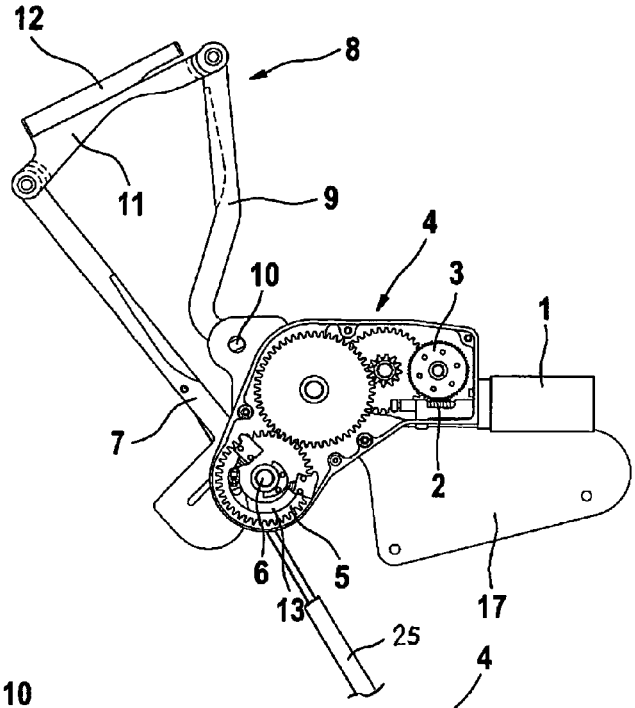
FIG. 5 is a schematic sectional side view of an actuating device of FIG. 1 in an open position.
Figure 6:
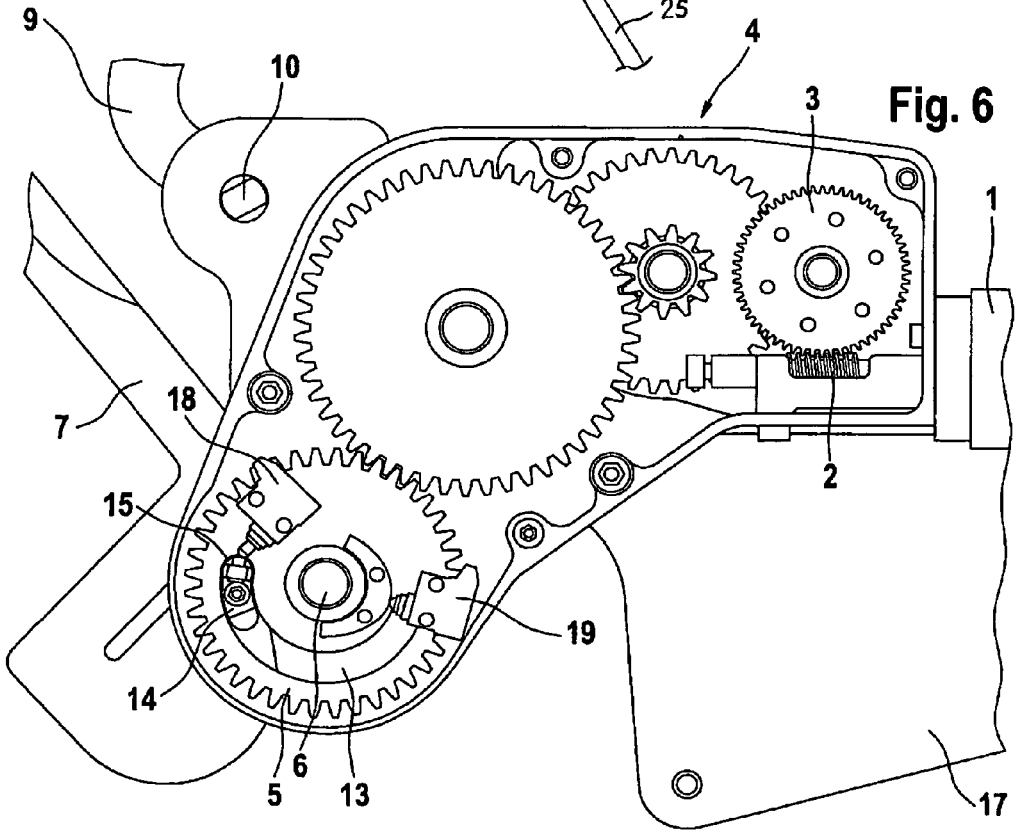
FIG. 6 is an enlarged side view of the actuating device according to FIG. 5.

A pneumatci spring 25 (FIGS. 1, 3, 5, and 7) acts on a component of the four bar linkage 8 or the flap 12 in the opening direction and moves the flap 12 until in its open position shown in FIG. 5. At the same time, the electromotor 1 drives the crank gear 5 anticlockwise in the now reversed rotational direction, until the driving element 14 comes to bear against the first stop 15 and the crank gear 5 is again in its normal position (FIGS. 5 and 6). It would now be possible for the flap 12 to be manually lowered and then raised, the driving element 14 moving freely in the crank recess 13.

Figure 7:
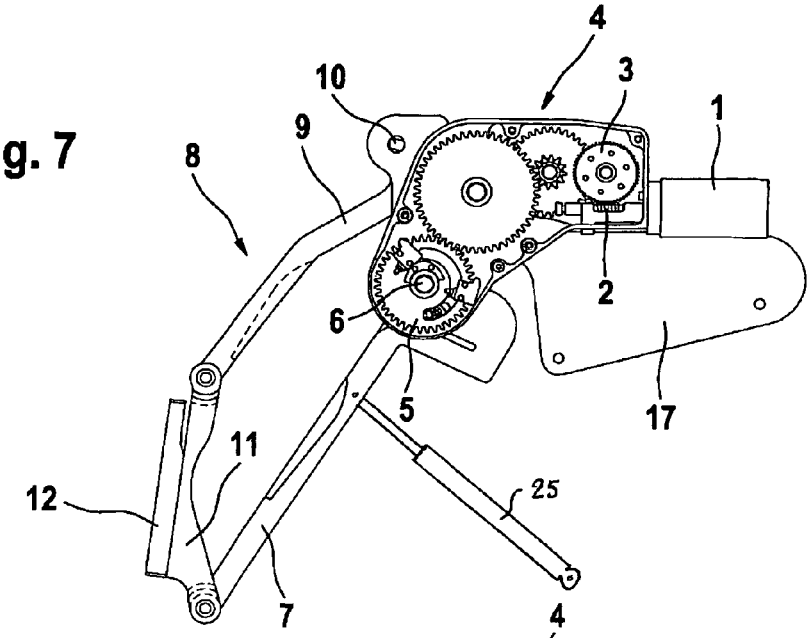
FIG. 7 is a schematic sectional side view of the actuating device of FIG. 1 in a partially lowered position.
Figure 8:
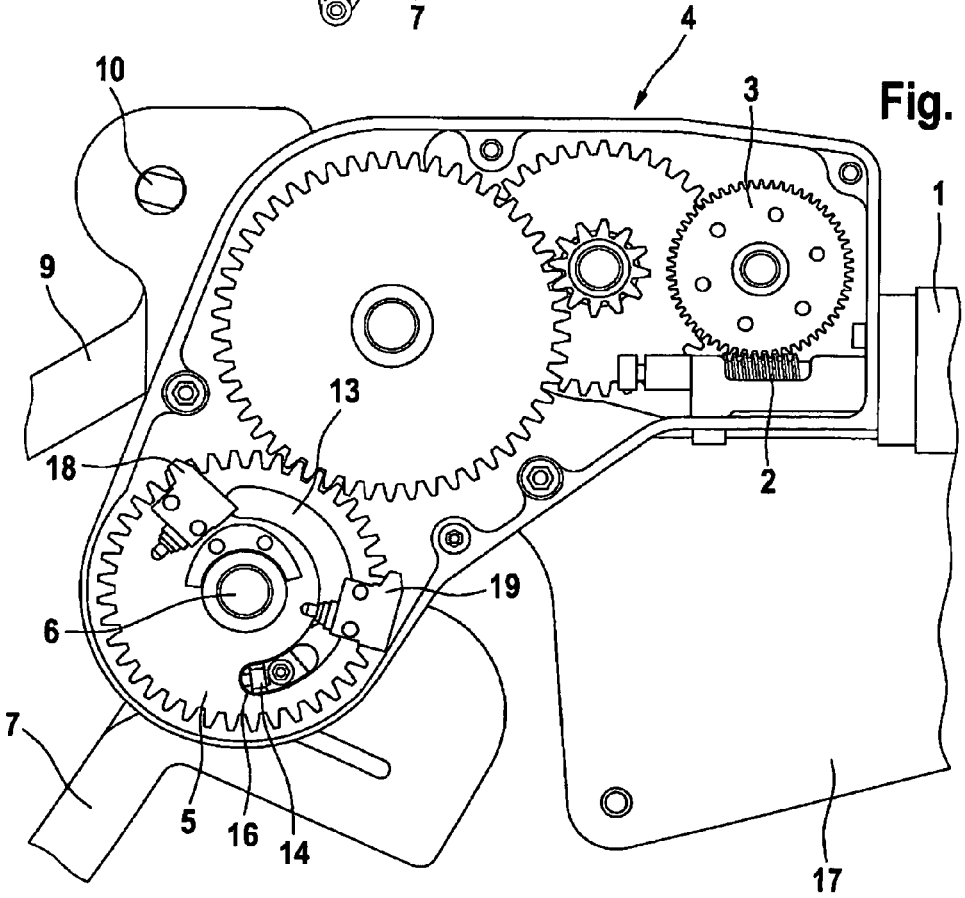
FIG. 8 is an enlarged side view of the actuating device according to FIG. 7.

For motorized closing, the electromotor 1 is switched on, which drives the crank gear 5 anticlockwise, so that the first stop 15 drives the driving element 14 and the four bar linkage 8 anticlockwise (FIGS. 7 and 8). If a specific angle is passed in the closing direction, the flap 12 closes automatically, due to its inherent weight, against the force of the pneumatic spring.

By means of the electromotor 1, the crank gear 5 is then moved again as far as its normal position as is shown in FIGS. 1 and 2.

Figure 9:
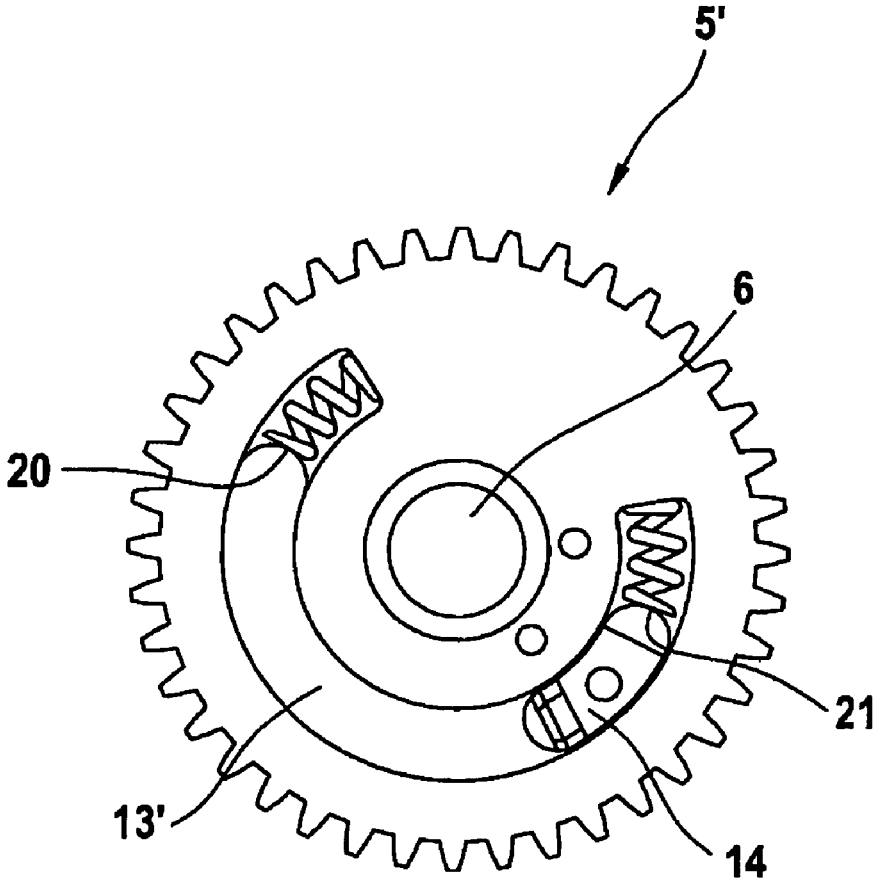
FIG. 9 is a side view of further embodiment of a crank gear.

A further embodiment of a crank gear 5' is shown in FIG. 9, in which a first spring stop 20 and a second spring stop 21 are arranged in the ends of the crank recess 13'. These spring stops 20 and 21 may be compressed when a set force applied by the driving element 14 is exceeded, whereby a switch signal is generated by switches, not shown, which results in the electromotor 1 being switched off. Alternatively, if an increased power consumption of the motor is identified, this may result in such a switching-off of the motor. This, however, only occurs with increased adjustment resistance as is, for example, provided in the event of manual intervention in the motorized adjustment motion of the flap 12. A normal motorized actuating drive does not result in any compression of the spring stops 20 and 21 or any triggering of a switch signal.

Figure 10:
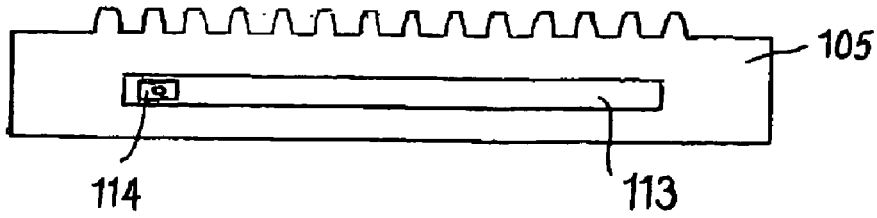
FIG. 10 is a side view of an embodiment crank element for implementing linear motion.

FIG. 10 shows a crank component 105 that is drivable in a linear movement between a normal position and an open position. The crank recess 113 extends in a straight line and engages a driving element 114.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An actuating device for moving a movable component, comprising:

a movable component movable from a normal position to an open position;

a driving element connected to said movable component;

a reversible motorized drive, wherein said driving element is drivable by said motorized drive for moving said movable component from the normal position to said open position, said motorized drive having a drive component defining a crank recess engaging said driving element, said crank recess extending in a circular arc shape along a path of motion of said driving element and having a length corresponding to a motion of the movable component between the normal position and a partially open or the open position;

a free wheel mechanism allowing the driving element to be uncoupled from said motorized drive in the open position; and a switching device operatively arranged so that after said movable component has reached the open position said driving element is drivable by said motorized drive back to said normal position, wherein said movable component is rotatable about a rotational axis between the normal position and the open position.

2. The actuating device of claim 1, wherein said switching device comprises at least one switching element configured to detect when the driving element has reached at least one end of said crank recess.

3. The actuating device of claim 1, wherein at least one end of said crank recess forms a stop against which said driving element bears during driving of said driving element by said motorized drive.

4. The actuating device of claim 3, wherein said stop comprises a spring stop which is deflected counter to a spring force when impinged upon by said driving element, said spring force being greater than the force applied by said driving element when said driving element is driven by said motorized drive and, wherein deflection of said spring stop by said driving element causes said switching device to identify the deflection by one of a switch signal being actuated or an increased power consumption of the motor, said switching device being configured to switch off said motorized drive when the deflection is identified by said switching device.

5. The actuating device of claim 1, wherein said motorized drive is a linear drive or a rotary drive.

6. The actuating device of claim 1, further comprising a gear mechanism, wherein said motorized drive is configured to drive said driving element through said gear mechanism.

7. The actuating device of claim 1, wherein said motorized drive is an electromotor.

8. The actuating device of claim 1, further comprising a spring applying a force urging said movable component in the direction of motion from the normal position into the open position.

9. The actuating device of claim 8, wherein said spring comprises a pneumatic spring.

10. The actuating device of claim 1, wherein said movable component is or carries a flap which closes an opening.

11. The actuating device of claim 10, wherein said flap is movably drivable from a vertical normal position into a raised open position.

12. The actuating device of claim 1, wherein the movable component is movably drivable in a linear manner between the normal position and the open position and said crank recess extends in a straight line.

13. The actuating device of claim 1, wherein said free wheel mechanism comprises a drive wheel defining said crank recess, said drive wheel being rotatably mounted about said rotational axis and rotatably drivable by said motorized drive.

14. The actuating device of claim 1, wherein said movable component is a lever arm.

15. The actuating device of claim 14, wherein said lever arm is one arm of a four bar linkage.

16. The actuating device of claim 15, further comprising said four bar linkage including said lever arm, a link rod pivotable with one end about a second rotational axis parallel to said rotational axis, and a connecting rod coupled to free ends of said lever arm and said link rod.

17. The actuating device of claim 16, further comprising a flap which closes an opening, said flap being fixedly arranged on said connecting rod.

18. An actuating device for moving a movable component, comprising:

a movable component movable from a normal position to an open position;

a driving element connected to said movable component;

a reversible motorized drive;

a crank component drivable by said motorized drive for moving said movable component from the normal position to said open position and defining a crank recess engaging said driving element, said crank recess extending in a circular arc shape along a path of motion of said driving element and having a length corresponding to a motion of the movable component between the normal position and a partially open or the open position;

a free wheel mechanism, said free wheel mechanism allowing the driving element to be uncoupled from said motorized drive in the open position; and a switching device operatively arranged so that after said movable component has reached the open position said driving element is drivable by said motorized drive back to said normal position;

wherein said movable component is rotatable about a rotational axis between the normal position and the open position.

19. The actuating device of claim 18, wherein said movable component is movably drivable by the reversible motorized drive through said crank component from the open position into the normal position and wherein said crank component is driven by said motorized drive into the normal position in response to said switching device after said movable component into its normal position.

20. The actuating device of claim 18, wherein said switching device comprises at least one switching element which detects when said driving element has reached an end of said crank recess.

21. The actuating device of claim 18, wherein at least one end of said crank recess forms a stop against which said driving element bears during driving of said driving element by said motorized drive.

22. The actuating device of claim 21, wherein said stop comprises a spring stop which is deflected counter to a spring force when impinged upon by said. driving element, said spring force being greater than the force applied by said driving element when said driving element is driven by said motorized drive and, wherein deflection of said spring stop by said driving element causes said switching device to identify the deflection by one of a switch signal being actuated or an increased power consumption of the motor, said switching device being configured to switch off said motorized drive when the deflection is identified by said switching device.

23. The actuating device of claim 18, wherein said motorized drive is a linear drive or a rotary drive.

24. The actuating device of claim 18, further comprising a gear mechanism, wherein said motorized drive is configured to drive said crank component through said gear mechanism.

25. The actuating device of claim 18, wherein said motorized drive is an electromotor.

26. The actuating device of claim 18, further comprising a spring applying a force urging said movable component in the direction of motion from the normal position into the open position.

27. The actuating device of claim 26, wherein said spring comprises a pneumatic spring.

28. The actuating device of claim 18, wherein said movable component is or carries a flap which closes an opening.

29. The actuating device of claim 28, wherein said flap is movably drivable from a vertical normal position into a raised open position.

30. The actuating device of claim 18, wherein the movable component is movably drivable in a linear manner between the normal position and the open position and said crank recess extends in a straight line.

31. The actuating device of claim 18, wherein said crank component comprises a crank gear rotatably mounted about said rotational axis and rotatably drivable by said motorized drive.

32. The actuating device of claim 31, wherein said movable component is a lever arm.

33. The actuating device of claim 32, wherein said lever arm is one arm of a four bar linkage.

34. The actuating device of claim 33, further comprising said four bar linkage including said lever arm, a link rod pivotable with one end about a second rotational axis parallel to said rotational axis, and a connecting rod coupled to free ends of said lever arm and said link rod.

35. The actuating device of claim 34, further comprising a flap which closes an opening, said flap being fixedly arranged on said connecting rod.

* * * * *